United States Patent [19]

Gustafsson

[11] 4,033,141

[45] July 5, 1977

[54] METHOD FOR THERMAL RUNNING OF A HEAT PUMP PLANT AND PLANT FOR CARRYING OUT THE METHOD

[75] Inventor: Berth Ulrik Gustafsson, Osterskar, Sweden

[73] Assignee: Projectus Industriprodukter AB, Stockholm, Sweden

[22] Filed: Aug. 27, 1975

[21] Appl. No.: 608,225

[30] Foreign Application Priority Data

Sept. 5, 1974 Sweden ..... 7411260

[52] U.S. Cl. ..... 62/238; 60/651; 60/671; 62/467 PR

[51] Int. Cl.[2] ..... F25B 27/02

[58] Field of Search ..... 60/651, 671; 62/86, 62/87, 116, 238, 401, 402, 403, 500, 467 PR

[56] References Cited

UNITED STATES PATENTS

| | | | |
|---|---|---|---|
| 2,952,138 | 9/1960 | Russell et al. | 62/238 |
| 3,052,106 | 9/1962 | Sampietro et al. | 62/87 X |
| 3,214,938 | 11/1965 | Zotos | 62/238 X |
| 3,276,226 | 10/1966 | Osborne | 62/500 X |
| 3,696,637 | 10/1972 | Ness et al. | 62/402 |

FOREIGN PATENTS OR APPLICATIONS

| | | |
|---|---|---|
| 196,299 | 5/1965 | Sweden |

*Primary Examiner*—Ronald C. Capossela
*Attorney, Agent, or Firm*—Toren, McGeady and Stanger

[57] ABSTRACT

Waste heat from paper mills, for example, is used partly as energy input to a heat motor, partly as energy input to a heat pump. The heat motor drives the compressor of the heat pump which means that no external high grade energy has to be supplied to drive the heat pump. The heat leaving the hot side of the heat pump can be utilized readily, directly or after heating of feed water, for example, possibly for vaporization thereof, for example, in the process that left the waste heat.

16 Claims, 1 Drawing Figure

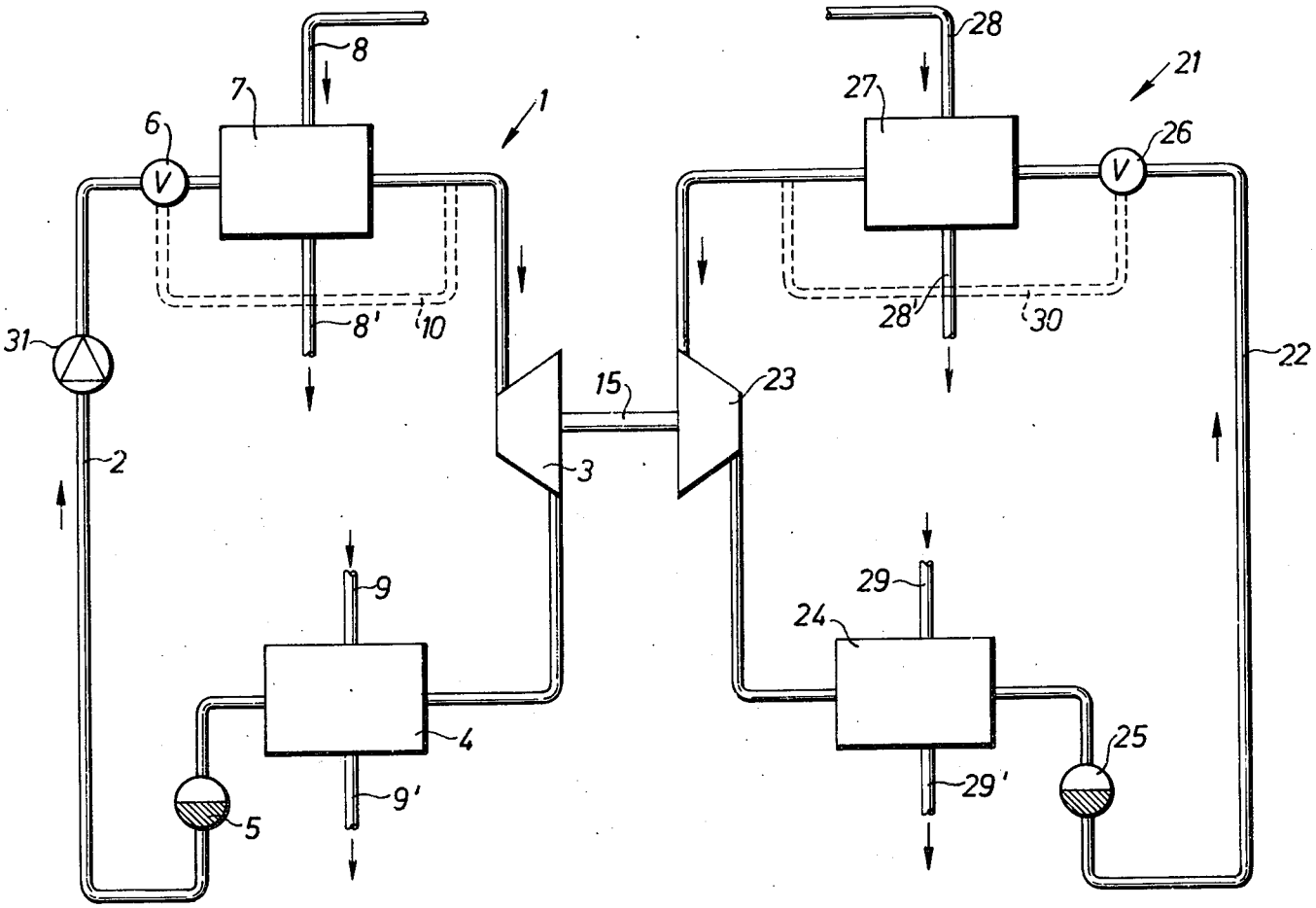
1
2
3
4
5
6
7
8
8'
9
9'
10
15
21
22
23
24
25
26
27
28
28'
29
29'
30
31

METHOD FOR THERMAL RUNNING OF A HEAT PUMP PLANT AND PLANT FOR CARRYING OUT THE METHOD

The invention relates to a method for thermal running of a heat pump plant and a plant for carrying out this method.

Process industries, such as paper mills, have a high consumption of energy but only a part of the energy supplied is utilized by the process whereas considerable quantities of low temperature energy, often carried by contaminated medium, are disposed of together with coolant-water, vapor and air.

This loss of energy is not only an economic factor affecting the process, it is also a threat to the surroundings which are forced to take the waste heat.

It might seem obvious to propose using heat pumps to transfer the low temperature energy to high temperature energy which can be utilized in the process. However, existing heat pumps driven by electric motors require an unacceptably amount of electric power for operation and hitherto such heat pump application has, therefore, not been considered.

Similar problems exist in power stations, such as nuclear power stations, where the cooling water and/or air is to be used for district heating. The difficulty here is that the cooling water normally has too low a temperature for it to be of any use in heating and hot water systems of the type existing in housing areas nowadays. Once again the idea of using heat pumps to increase the temperature level is rejected because these pumps require too much power in order to operate and this must be taken from some form of energy which can be better used elsewhere.

One object of the invention is therefore to provide a method for thermal running of a heat pump plant by which the plant is driven by a part of the available low temperature energy and thereby transfer another part of the low temperature energy to high temperature energy.

Another object is in such a plant to permit utilization of low temperature energy carried by different fluids which may have different temperatures.

Another object is to reduce the energy waste in process industries and heat-power plants, for example.

Another object is to reduce the water consumption in process industries such as paper mills.

Technology most closely resembling the invention is represented by Swedish Pat. No. 196,299 and U.S. Pat. Nos. 3,214,938 and 3,696,637. However, these only relate to cooling systems operating with a single fluid which undergoes compression and expansion, respectively, and which, in order to function, require either electric motors or corresponding sources of energy. In any case, the methods disclosed in these patent specifications cannot be applied in order to achieve the objects or solve the problems dealt with by the invention.

According to the invention said drawbacks are eliminated and said objects achieved by transferring heat by means of heat-exchange from a first medium, and possibly a second medium, to a refrigerant in a first circuit to vaporize the refrigerant, driving an expansion motor by means of the vaporised refrigerant, after passage through the motor, condensing the refrigerant in a condenser by means of heat-exchange with a coolant, and then recirculating the refrigerant for heat-exchange with the first medium, transferring heat by means of heat-exchange from the second medium and possibly the first medium to a refrigerant in a second circuit to vaporize the refrigerant, compressing the vaporized refrigerant by means of a compressor, driving the compressor by means of the expansion motor, and heating a third medium in a condenser in the second circuit by means of heat-exchange with the compressed vapour of the refrigerant of the second circuit, which after condensation in said condensor is recirculated for heat-exchange with the second medium.

The first medium and the second medium may in this case be parts of the same fluid. Furthermore, the first medium and the second medium may have different temperatures. The first medium may consist of hot water, while the second medium may consist of hot air, or vice versa. The third medium may consist of feed water which is transferred to steam which may be used, for example, to dry pulp in the paper industry. Alternatively, the feed water may be heated to around 90° C, for instance if the invention is being used to temper water from a nuclear power station being used for district heating.

A heat pump plant according to the invention for performing the method described above is characterized by a first circuit including in series a vaporizer which is arranged to vaporize the refrigerant of the circuit by means of heat-exchange with a first medium and possibly a second medium, an expansion motor which is arranged to be driven by the refrigerant vapour, a condenser which is arranged to condense the refrigerant by means of heat-exchange with a coolant, and a pump for circulating the refrigerant, a second circuit including in series a vaporizer which is arranged to vaporize the refrigerant of the second circuit by means of heat-exchange with the second medium and possibly the first medium, a compressor which is arranged to compress refrigerant vapour, a condenser which is arranged to heat a third medium by means of heat-exchange with the refrigerant during condensing thereof and a transmission means to drive the compressor from the motor.

The transmission means may consist of a shaft which is common to the motor and the compressor and both motor and compressor may be of the turbine type.

The invention is closer defined in the enclosed claims.

The invention will be described more fully in the following with reference to the accompanying drawing.

A circuit, generally designated 1, is shown on the left hand side of the drawing. The circuit 1 is arranged to drive an expansion motor and comprises a closed pipe circuit 2 for a refrigerant, suitably a fluoridated hydrocarbon such as R22. The closed circuit 2 comprises in series an expansion motor 3, a condenser 4, a drop catcher 5, a circulation pump 31, an expansion valve 6 and a vaporizer 7.

The coolant of the circuit 1 is vaporized in the vaporizer 7 by means of heat-exchanging with hot water 8, which may be cooling water from any process. The vaporized refrigerant flows through the motor 3, driving this, to be afterwards condensed in the condenser 4 by means of heat-exchange with coolant 9 which may consist of lake water or sea water. The refrigerant flows away via the drop catcher 5 and is forced by the pump 31 to the expansion valve 6 which controls expansion of the refrigerant by sensing, via conduit 10, the pressure of the refrigerant between vaporizer 7 and motor 3. The refrigerant expanded in the expansion valve 6 is then sprayed into the vaporizer 7 for vaporization. The motor 3 is preferably an expansion turbine. 8' refers to the cooled hot water leaving the heat exchanger 7. 9' refers to the slightly heated coolant leaving the heat exchanger 4.

On the right hand side of the drawing a second heat pump circuit 21 is shown, arranged to be driven by a compressor. The circuit 21 comprises a closed circuit 22 for a refrigerant, suitably a fluoridated hydrocarbon such as R11. The circuit 22 comprises in series a compressor 23, a condenser 24, a drop catcher 25, an expansion valve 26 and a vaporizer 27.

Refrigerant is vaporized in the vaporizer 27 by means of heat-exchange with hot water 28 which may be the cooling water from a process, for example. The refrigerant vaporized in the vaporizer flows to the compressor 23 which is driven by the motor 3 via a shaft 15. The hot, compressed refrigerant flows from the compressor 23 to the condensor 24 where, by means of heat-exchange, it transfers its heat content to the feed water 29, the temperature of which is therefore raised and it may even be converted to steam. The refrigerant cooled in the condenser 24 then flows via the drop catcher 25 to the expansion valve 26 which controls expansion of the refrigerant by sensing, via conduit 30, the pressure of the refrigerant between the vaporizer 27 and the compressor 23. The refrigerant then flows from the expansion valve 26 into the vaporizer 27 for vaporization. The compressor 23 is preferably of turbine type. 28' refers to the cooled hot water (waste water) leaving the heat exchanger 27. 29' refers to the heated feed water leaving the heat exchanger 24.

The circuits 1 and 21 are separate from each other.

If the hot water 8, 28 has a temperature of say 45° C, the refrigerant of the first circuit 1 is R22. The refrigerant of the heat pump is R11 and the cooling water 9 has a temperature of 20° C, the pressure of R22 will vary between approximately 15.5. ata (40° C) and 9.2 ata (20° C) while the pressure of R11 will vary between approximately 1.8 ata (40° C) and a pressure depending on the temperature to which it is desired to bring the feed water. If the feed water is to be given a temperature of 105° C, for example, that is to say it is to be vaporized, the R11 must be compressed to a pressure of 9.5 ata. This means that the compressor must be able to achieve a compression ratio of 5.2:1, which is possible with relatively simple turbo-compressors.

Generally, the refrigerant has an effective working range of around 60° C. As the circuit 1 normally shall operate in a first temperature range (between 50° and 20° C, for example) and the circuit 21 normally shall operate in a second temperature range (between 50° to 100° C for example) it is necessary to utilize different refrigerants for the separate circuits 1, 21 in order to provide an efficient operation.

The vaporization described above is performed by vaporizing the refrigerants by means of hot water 8 and 28, respectively, but it should be appreciated that other fluids are also possible. Within the paper industry the waste heat is often carried by moist air and also by water, these fluids being of different temperatures. Thus, for instance, the vaporizer 7 in circuit 1 may be supplied by such hot, moist air whereas the vaporizer 27 of the circuit 21 is supplied by hot water 28, or vice versa. Of course any of the vaporizers 7 or 27 may be replaced by a two-step vaporizing unit in which vaporization of the refrigerant is effected by two fluids of different temperatures and/or types.

Furthermore, the cooling water 9 of the condensor 4 in circuit 1 may be replaced by air from the atmosphere, for example.

Furthermore, the feed water 29 which is heated in the condensor 24 of circuit 21 may of course also be replaced by some other fluid which one desires to bring to a higher temperature.

The expansion turbine 3 and the compressor turbine 23 may be fitted on a common shaft and in this way the unit 3, 23 will be very compact. It is of course quite possible to substitute a gear transmission or speed gear for the shaft 15.

The above is a description of a schematic embodiment of a plant according to the invention. However, it should in no way be considered as limiting, but merely serve to illustrate the invention.

The essential concept of the invention is the principle that waste heat of low temperatures, which may be carried by different fluids, possibly having different temperatures, is used to drive a heat engine which is utilized to drive a compressor in a heat pump, which circuit the refrigerant of which receives at least part of the waste heat which is brought to a relatively high temperature level by the compressor, so that its energy content readily can be utilized, normally after transfer to feed water or the like, in a simple and economic manner. For example, waste heat from a paper mill can be transferred to high temperature heat, useful in the process that left the waste heat.

What is claimed is:

1. Method for thermal running of heat pump plant, characterized by a. transferring heat in a first circuit by means of indirect heat-exchange from a first fluid medium from another source separate from the first circuit, at a first inlet temperature to a refrigerant flowing in the first circuit to vaporize the refrigerant, b. driving an expansion motor by means of the vaporised refrigerant, c. after the motor, condensing the refrigerant in a condenser by means of heat-exchange with a fluid coolant, and then recirculating the refrigerant for heat-exchange with the first medium, d. transferring heat in a second circuit by means of heat-exchange from a fluid second medium from another source separate from the second circuit at a second inlet temperature to a refrigerant flowing in the second circuit to vaporize the refrigerant, e. compressing the vaporized refrigerant of the second circuit by means of a compressor, f. driving the compressor by means of the expansion motor in the first circuit, and g. heating a third fluid medium to an outlet temperature higher than both the first inlet temperature of the first medium and the second inlet temperature of the second medium in a condenser in the second circuit by means of heat-exchange with the compressed vapour of the refrigerant of the second circuit, which after condensation in said condenser is recirculated for heat-exchange with the second medium.

2. Method according to claim 1, characterized in that the first medium and the second medium are parts of the same fluid.

3. Method according to claim 1, characterized in that the first and the second medium have different temperatures.

4. Method according to claim 1, characterized in that the first medium consists of hot water and that the second medium consists of hot air.

5. Method according to claim 1, characterized in that the third medium is feed water.

6. Method according to claim 1, characterized in that the first medium consists of hot air and that the second medium consists of hot water.

7. Thermally run pump plant.comprising

A. a first closed circuit including in series
   a. a vaporizer which is arranged to vaporize the refrigerant of the circuit by means of indirect heat-exchange with a first medium at a first inlet temperature,
   b. an expansion motor which is arranged to be driven by the refrigerant vapour,
   c. a condenser downstream from said expansion motor which is arranged to condense the refrigerant by means of indirect heat-exchange with a coolant, and
   d. a pump for circulating the refrigerant, B. a second circuit including in series
   a. a vaporizer which is arranged to vaporize the refrigerant of the second circuit by means of indirect heat-exchange with the second medium at a second inlet temperature,
   b. a compressor which is arranged to compress refrigerant vapour,
   c. condenser which is arranged to heat a third medium to an outlet temperature higher than both first and second inlet temperatures by means of heat-exchange with the refrigerant during condensing thereof, and C. a transmission means for driving the compressor in the second circuit from the motor in the first circuit.

8. Plant according to claim 7, characterized in that the first medium and the second medium are parts of the same fluid.

9. Plant according to claim 7, characterized in that the first and the second medium have different temperatures.

10. Plant according to claim 7, characterized in that the first medium consists of hot water and that the second medium consists of hot moisty air.

11. Plant according to claim 7, characterized in that the transmission means is a shaft which is common to the motor and the compressor.

12. Plant according to claim 7, characterized in that both pump and motor are of turbine type.

13. Plant according to claim 7, characterized in that the third medium is feed water.

14. Plant according to claim 13, characterized in that said condenser in the second circuit is arranged to heat up the feed water to vaporization.

15. Plant according to claim 7, characterized in that the coolant is lake or sea water.

16. Plant according to claim 7, characterized in that the first medium consists of hot moisty air and that the second medium consists of hot water.

* * * * *